United States Patent [19]

Blayman

[11] 4,161,131

[45] Jul. 17, 1979

[54] MUSICAL INSTRUMENT SUPPORTING STAND

[76] Inventor: Herbert S. Blayman, 195 Jefferson Ave., Tenafly, N.J. 07670

[21] Appl. No.: 849,558

[22] Filed: Nov. 8, 1977

[51] Int. Cl.[2] ..... G10D 9/00; G10G 5/00

[52] U.S. Cl. ..... 84/453; 248/511

[58] Field of Search ..... 84/453, 380 R, 327; 248/511, 519, 171, 309 A; 206/314

[56] References Cited

U.S. PATENT DOCUMENTS

| | | | |
|---|---|---|---|
| 1,268,363 | 6/1918 | Lamont | 248/171 |
| 2,920,851 | 1/1960 | Carlini | 84/453 X |
| 3,203,298 | 8/1965 | Sumrall | 206/314 X |

*Primary Examiner*—John Gonzales

*Attorney, Agent, or Firm*—Shoemaker and Mattare, Ltd.

[57] ABSTRACT

A stand for supporting musical instruments, such as clarinets and flutes. The stand includes air vent channels for conducting air into an instrument supported on the stand for retarding condensation of moisture in the instrument to prevent clogging of the instrument tone holes.

10 Claims, 5 Drawing Figures

MUSICAL INSTRUMENT SUPPORTING STAND

BACKGROUND OF THE INVENTION

The present invention relates, in general, to supporting stands, and more particularly, to stands for supporting musical instruments.

Many musical compositions require some musicians to play a plurality of clarinets or flutes during the performance of that single composition.

During a performance, a musician is concerned with many problems, and the change-off of one instrument for another should be as easy and convenient as possible. Therefore, any device used to store the instruments while those instruments are temporarily not in use should, at least, maintain those instruments in as convenient a location and orientation as possible.

During such an in-performance storage of an instrument, moisture may condense therein and clog the tone holes of that instrument. Such tone hole clogging may impair the instrument, or even render that instrument inoperative.

There are many known devices for holding musical instruments. These known holding devices include special clarinet holders, combination holders and carrying cases, and even combination clarinet and reed holders. However, none of these known devices are concerned with, or solve, the just-mentioned problem of moisture condensation in the instrument tone holes. Even those devices which include means for holding a reed do not recognize this tone hole clogging condensation problem, nor disclose any means for solving that problem. These known supports are used strictly for support and do not have any means for preventing instrument tone hole clogging by moisture condensation. Thus, once an instrument is supported on these known devices, moisture may begin condensing in the tone holes, which moisture may ultimately impair or render that instrument inoperative.

SUMMARY OF THE INVENTION

The instrument holder embodying the teachings of the present invention retards the condensation of moisture in the instrument thus supported to prevent clogging of the instrument tone holes.

The holder embodying the teachings of the present invention comprises a heavy pedestal having defined therein a plurality of mounting holes. Stanchions are removably mounted on the pedestal to support the musical instruments thereon. One stanchion has a frustoconical central section and is thus bell-shaped to accommodate the bell-shaped section of a clarinet, and another stanchion is cylindrical and is thus shaped to support a flute.

The stanchions have ribs defined on the outer surfaces thereof which, in conjunction with that outer surface, define a plurality of air vent channels. The air vent channels in the clarinet stand have a depth which varies from a minimum at the top of the channel to a maximum at the bottom thereof, and the flute stanchion has air vent channels of essentially constant depth.

The stanchions each have a base section which has air vent channels defined by ribs to be fluidly connected to the just-discussed air vent channels, and the instrument can rest on the top surface of the air vent channel defining rib.

Air thus circulates into the interior of the instrument supported by the holder near the air vent channels. The instrument can contact the stanchion at any location and air will still bypass that contact point via the channels as the contact between the instrument and the stanchion occurs on the top surface of the channel-defining ribs. There is thus an air path defined in the channels past the point of contact between the instrument and the stanchion.

The air circulation into and through the instrument enables moisture to escape therefrom, and thus retards, and even prevents, condensation of moisture in the instrument, and thereby prevents clogging of the instrument tone holes, which clogging may result in the impairment, or even inoperability, of the instrument.

OBJECTS OF THE INVENTION

It is, therefore, a main object of the present invention to allow air circulation to and through an instrument which is being temporarily supported.

It is another object of the present invention to retard moisture condensation in an instrument which is being temporarily supported during a performance.

It is a further object of the present invention to prevent moisture clogging of tone holes in musical instruments.

It is yet another object of the present invention to provide a sturdy support stand for temporarily supporting musical instruments.

It is yet a further object of the present invention to provide a sturdy support stand which is easily knocked down for storage and transportation.

These together with other objects and advantages which will become subsequently apparent reside in the details of construction and operation as more fully hereinafter described and claimed, reference being had to the accompanying drawings forming part thereof, wherein like reference numerals refer to like parts throughout.

DETAILED DESCRIPTION OF THE INVENTION

Figure 1:
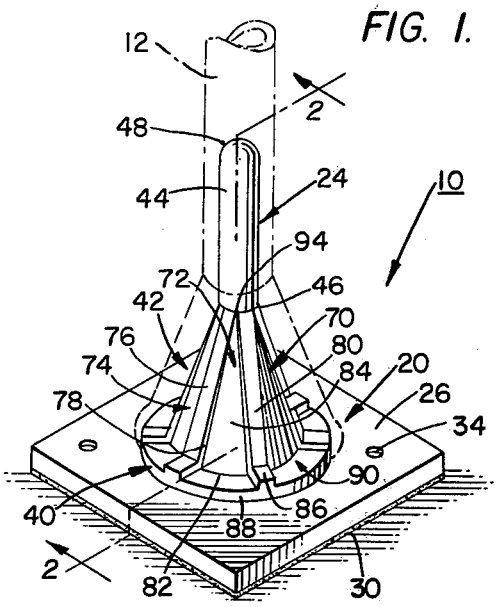
FIG. 1 is a perspective view of a clarinet holder embodying the teachings of the present invention.

Shown in FIG. 1 is an instrument stand 10 for supporting musical instruments, such as a clarinet 12 or a flute 14 (FIG. 4), when those instruments are temporarily not in use. The stand 10 includes a pedestal 20 which serves as a foundation for the stand, and an upstanding stanchion 24 removably connected to that pedestal. The pedestal is, in the preferred embodiment, a quadralateral, preferably rectangular in peripheral outline, and has a uniplanar top surface 26 and a uniplanar bottom surface 28 (FIG. 2) to which is attached a covering material 30, such as felt or the like. The pedestal 20 can assume outline shapes other than the rectangular shape shown in the Figures without departing from the teachings of the present invention, and is heavy enough to securely support an instrument on that stand without danger of tipping.

Figure 2:
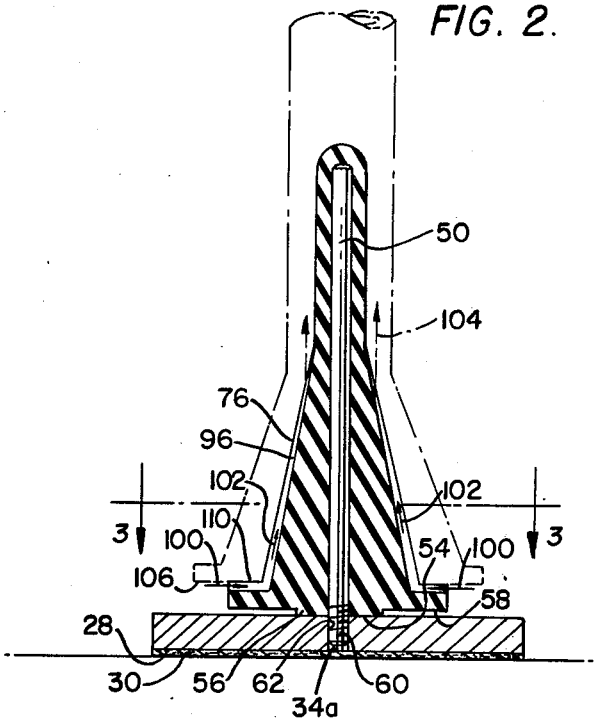
FIG. 2 is an elevation view taken along line 2—2 of FIG. 1.
Figure 3:
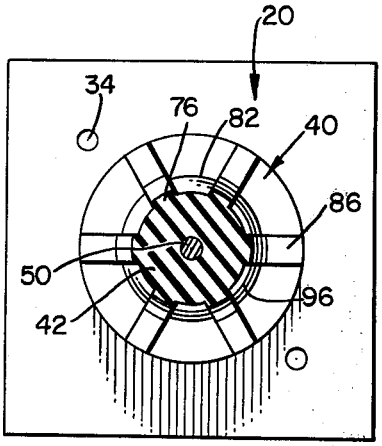
FIG. 3 is a plan view taken along line 3—3 of FIG. 2.

As shown in FIGS. 1 and 3, there are a plurality of mounting holes 34 defined in the pedestal. The holes are spaced apart along a diagonal of the pedestal, with one hole 34a (FIG. 2) being located centrally of the pedestal. However, other configurations could be used without departing from the teachings of the present invention. The holes are blind-ended and internally threaded for a purpose to be described hereinafter.

The stanchion 24 is shown in FIG. 1 to include a base 40 which has a circular outer peripheral shape and an upright section which includes a frusto-conical central section 42 and a prong section 44 projecting upwardly from the top 46 of the central section frustum and terminating in an upper rounded tip 48. The stanchion upright section is shaped to correspond to the shape of the outer end of a clarinet which is bell-shaped as shown in the Figures. A stud 50 is securely embedded in the stanchion, extends along the central longitudinal axis thereof as shown in FIG. 2, and has the lower tip thereof extending downwardly beyond lower surface 54 of boss 56 which projects outwardly of base lower surface 58. The boss 56 may have any suitable peripheral shape, but preferably is circular to be concentric with the circular base 40. The lower end of the stud has external threads 60 defined therein to cooperatively associate with the internal threads 62 defined in the pedestal within the mounting holes 34 to detachably, although securely, mount the stanchion onto the pedestal, as shown in FIGS. 1 and 2, to thereby support a musical instrument such as a clarinet 12.

As aforediscussed, when an instrument is temporarily resting on a stand during a performance of a musical composition, moisture often condenses thereon and may damage that instrument by, as for example, clogging the tone holes thereof, or the like. To allow air to circulate through an instrument resting on the stand 10, vent means 70 is provided. As shown in FIGS. 1 and 2, the vent means 70 includes a plurality of vent channels 72 defined in the outer surface of central portion 42 and base 40. The vent channels are each defined by raised ribs 74, each having a top surface 76 and edge surfaces 78. The ribs are divided into two sections, an upper section 80 extending from the central portion frustum top 46 to intersection 82 between the central portion 42 and the base 40 to form central portion vent channels 84, and base portion 86 located on the base 40 and extending from intersection 82 to outer edge 88 of that base to form base vent channels 90. The central section ribs and the base section ribs are fluidly connected together at a location adjacent the intersection 82. The upper sections of the ribs extend longitudinally on the central portion and therefore form angles with respect to each other due to the sloped nature of the central portion outer surface. Adjacent upper section ribs have the adjacent edges thereof intersecting each other in the vicinity of frustum top 46 to form an apex 94 of each angular central portion vent channel.

As shown in FIGS. 1 and 2, the thickness of each rib, as measured from the surface 96 of the central portion included in the vent channel to the top surface 76 of each rib, increases uniformly from nearly flush adjacent the frustum top 46 to a maximum adjacent the intersection 82. The thickness of the base portion ribs is uniform and corresponds to the maximum thickness of the upper section ribs.

A bas-relief is thereby formed on the stanchion central and base sections which defines vent channels to permit air to circulate into an instrument supported by the stand 10. The air thus enters the instrument via the base vent channels 90, as indicated by arrows 100 in FIG. 2, and circulates upwardly into the interior of that instrument via the central portion vent channels 84 as indicated by arrows 102 in FIG. 2. The air can bypass the point at which the instrument contacts the stanchion, as that contact occurs along the rib upper surfaces 76, thereby forming bypass routes for the air to continue the upward flow thereof into the instrument, as indicated by arrows 104 in FIG. 2.

The instrument is shown in FIG. 2 as being supported on the base ribs, but can be supported on the central portion ribs so that instrument lower surface 106 is spaced apart from upper surface 110 of the base ribs. The bypass means defined in the vent channels will still be defined by the vent channels at that point of contact, so that air can circulate into the interior of the instrument via the vent channels.

Figure 4:
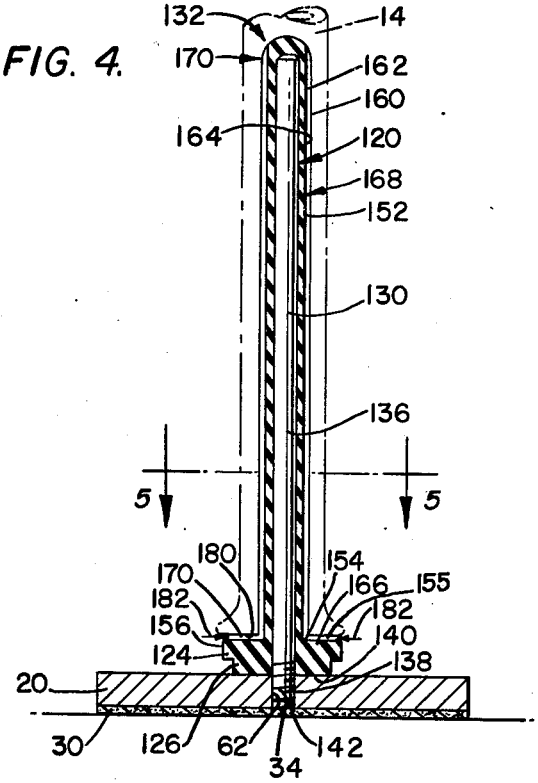
FIG. 4 is an elevation view of a flute holder embodying the teachings of the present invention.
Figure 5:
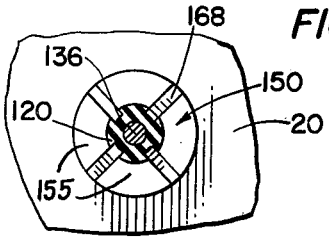
FIG. 5 is a plan view taken along line 5—5 of FIG. 4.

A stanchion suitable for supporting a flute 14 is shown in FIGS. 4 and 5, and is indicated by the numeral 120. The stanchion 120 includes a base 124 which is circular in peripheral outline and has a circular boss 126 located therebeneath. The stanchion 120 also has an upright section which includes a cylindrical upstanding prong 130 having a uniform girth and extends upwardly from the base and terminates in an upper rounded tip 132. A stud 136 is embedded in the stanchion to be located on the longitudinal centerline thereof and has a lower portion 138 extending downwardly out of the stanchion beyond lower surface 140 of the boss 126. The stud lower portion 138 has external threads 142 defined thereon to cooperate with the internal threads 62 of the pedestal mounting holes 34 to detachably, although stably, mount the stanchion 120 on the pedestal 20.

As shown in FIGS. 4 and 5, a plurality of ribs 150 are defined on the stanchion 120 to project outwardly therefrom. The ribs each include an upper section 152 defined on the prong 130 from the top thereof to intersection 154 between the prong and the base, and a base section 155 which extends from the intersection 154 to outer edge 156 of the base, with the base sections being oriented at essentially right angles to the upper section ribs. The ribs each have a top surface 160 and edge surfaces 162 and define, with surface 164 of the prong and top surface 166 of the base, vent channels 168 and 170, respectively, which are fluidly connected together at a location adjacent intersection 154. The ribs are of uniform thickness, as measured between top surfaces 160 and prong surface 164, for essentially the entire length of both rib sections, with the exception of top portion 170 adjacent the prong tip 132 which tapers inwardly to conform to the rounded configuration thereof. The air vent channels thus are defined to extend from outer edge 156 of the base 124 to a location immediately adjacent the uppermost terminal point on tip 132.

Lower surface 180 of the flute is supported on the upper surface of the base ribs, and air thus circulates into the interior of the instrument via the air vent channels as indicated by arrows 182 in FIG. 4. The air circulation into and through the flute serves the same purpose as that air circulation into and through the clarinet shown in FIGS. 1 and 2.

As in the clarinet stand, a bypass means is defined by the air vent channels at the point of contact between the instrument and the stanchion. The instrument rests on the top surfaces of the ribs, and thus air is permitted to circulate in the air channels past the point of contact, and into the instrument to retard the afore-discussed moisture condensation in the instrument tone holes.

The pedestal 20 is used with either or both of the stanchions, and is heavy enough to stably support more than one instrument thereon at the same time. In the preferred embodiment, the pedestal is comprised of a steel plate which has dimensions of 5 inches by 5 inches by ½ inch, and weighs approximately 4 pounds. The stanchions 24 and 120 are preferably formed of a rubber composition.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intented to be embraced by those claims.

I claim:

1. A device for holding musical instruments comprising:

a pedestal;

a stanchion mounted on said pedestal for supporting the musical instrument, said stanchion including an upright section and a base; and a plurality of air vents defined in said upright section and a plurality of air vents defined in said base with said base and upright section air vents being fluidly coupled together for conducting air into the instrument supported on the stanchion, said air vents each including a base surface and a pair of ribs, with each rib having a top surface and an edge surface intersecting said base surface so that said top surfaces are spaced from said base surface to define a channel, through which air passes, said air retarding moisture condensation in the instrument, the instrument contacting said rib top surfaces to be supported thereon with a bypass means being defined in said channels through which air moves into the instrument past the point of contact between the instrument and said stanchion when that instrument is supported on said stanchion.

2. The device of claim 1, wherein said stanchion upright section includes a frusto-conical central section mounted on said base and a cylindrical prong section mounted on the top of said central section.

3. The device of claim 1, wherein said stanchion upright section includes a cylindrical prong mounted on said base.

4. The device of claim 2, wherein said air vents increase in thickness from a minimum thickness at a location adjacent the frustum to a maximum thickness adjacent the base.

5. The device of claim 2, wherein said stanchion upright section air vents are triangular in shape with the apex thereof located adjacent the frustum.

6. The device of claim 1, further including a plurality of mounting holes defined in said pedestal.

7. The device of claim 6, further including a stud in said stanchion which engages said mounting holes for mounting said stanchion on said pedestal.

8. The device of claim 6, further including internal threaded coupling means defined on said base in said mounting holes and external threaded coupling means defined on said stud for engaging said internal threaded coupling means to mount said stanchion on said pedestal.

9. The device of claim 1, further including a boss on said base positioned to engage a top surface of said pedestal when said stanchion is mounted thereon.

10. The device of claim 1, wherein said stanchion comprises a rubber composition.

* * * * *